US011749163B1

(12) United States Patent
Tsung et al.

(10) Patent No.: US 11,749,163 B1
(45) Date of Patent: Sep. 5, 2023

(54) COLOR CALIBRATION DEVICE, COLOR CALIBRATION METHOD, AND CALIBRATION TABLE GENERATION METHOD

(71) Applicant: Novatek Microelectronics Corp., Hsinchu (TW)

(72) Inventors: Wan-Nung Tsung, Taipei (TW); Jun-Yu Yang, Hsinchu (TW); Shang-Yu Su, Hsinchu County (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/705,419

(22) Filed: Mar. 28, 2022

(51) Int. Cl.
*G09G 3/20* (2006.01)

(52) U.S. Cl.
CPC ... *G09G 3/2003* (2013.01); *G09G 2320/0242* (2013.01); *G09G 2320/0693* (2013.01)

(58) Field of Classification Search
CPC ..... G09G 3/2003; G09G 2320/0242; G09G 2320/0693
See application file for complete search history.

(56) References Cited

U.S. PATENT DOCUMENTS

| | | | | |
|---|---|---|---|---|
| 6,243,059 | B1 | 6/2001 | Greene et al. | |
| 10,311,776 | B2 * | 6/2019 | Park | G09G 3/2003 |
| 2018/0158173 | A1 | 6/2018 | Gao et al. | |
| 2018/0225075 | A1 * | 8/2018 | Park | G09G 3/3233 |
| 2018/0295312 | A1 * | 10/2018 | Cho | G09G 3/2007 |
| 2020/0193897 | A1 * | 6/2020 | Park | G09G 3/2007 |

* cited by examiner

*Primary Examiner* — Kenneth Bukowski
(74) *Attorney, Agent, or Firm* — JCIPRNET

(57) ABSTRACT

The invention provides a color calibration device, a color calibration method and a calibration table generation method. The color calibration device includes a calibration table circuit, a ratio circuit and an image processing circuit. The calibration table circuit provides a selected calibration table including a plurality of zone calibration parameters. Each of the zone calibration parameters corresponds to a corresponding zone among a plurality of zones of a display panel. The ratio circuit calculates a subpixel calibration parameter corresponding to a current subpixel according to at least one of the zone calibration parameters in the selected calibration table. The image processing circuit calibrates original subpixel data of the current subpixel according to the subpixel calibration parameter to generate calibrated subpixel data of the current subpixel.

16 Claims, 2 Drawing Sheets

COLOR CALIBRATION DEVICE, COLOR CALIBRATION METHOD, AND CALIBRATION TABLE GENERATION METHOD

BACKGROUND

Technical Field

The disclosure relates to a display device, and in particular, to a color calibration device, a color calibration method, and a calibration table generation method.

Description of Related Art

Self-luminous panels are adopted in many display devices, such as organic light-emitting diode (OLED) panels. Currently, the OLED panels have been widely used in various display devices. Due to process drift and/or different environmental conditions, red, green, and blue brightness ratios of pixels of each zone in the OLED panels may be inconsistent, leading to primary color shift. A color shift region may be irregular and covers a large area.

SUMMARY

The disclosure is directed to a color calibration device, a color calibration method, and a calibration table generation method to perform color calibration of a display panel.

In an embodiment of the disclosure, the color calibration device includes a calibration table circuit, a ratio circuit, and an image processing circuit. The calibration table circuit is configured to provide a selected calibration table. The selected calibration table includes multiple zone calibration parameters. Each of the zone calibration parameters corresponds to a corresponding zone among multiple zones of a display panel. The ratio circuit is coupled to the calibration table circuit to receive the selected calibration table. The ratio circuit is configured to calculate a subpixel calibration parameter corresponding to a current subpixel according to at least one of the zone calibration parameters in the selected calibration table. The image processing circuit is coupled to the ratio circuit to receive the subpixel calibration parameter. The image processing circuit is configured to calibrate original subpixel data of the current subpixel according to the subpixel calibration parameter to generate calibrated subpixel data of the current subpixel.

In an embodiment of the disclosure, the color calibration method includes the following. A selected calibration table is provided by a calibration table circuit. The selected calibration table includes multiple zone calibration parameters, and each of the zone calibration parameters corresponds to a corresponding zone among multiple zones of a display panel. A subpixel calibration parameter corresponding to a current subpixel is calculated by a ratio circuit according to at least one of the zone calibration parameters in the selected calibration table. Original subpixel data of the current subpixel is calibrated by an image processing circuit according to the subpixel calibration parameter to generate calibrated subpixel data of the current subpixel.

In an embodiment of the disclosure, the calibration table generation method includes the following. A display panel is divided into multiple zones. A color space value of each of the zones is measured, and each of the zones has a transformation function to convert original pixel data into the color space value. $Mt=TFi(Di*Pi)$ is calculated to obtain a zone calibration parameter Pi of a current zone. Mt is the color space value of a target zone among the zones, TFi( ) is the transformation function corresponding to the current zone among the zones, and Di is the original pixel data of the current zone. The zone calibration parameter corresponding to each of the zones is filled in a calibration table.

Based on the above, the calibration table generation method described in each of the embodiments of the disclosure may measure the color space value of each of the multiple zones of the display panel, and the zone calibration parameters of the zones are obtained according to the color space values of the zones. The zone calibration parameters of the zones may be filled in the calibration table. In a normal display period, the color calibration device may calculate the subpixel calibration parameter corresponding to the current subpixel according to the calibration table and calibrate the original subpixel data of the current subpixel according to the subpixel calibration parameter. Therefore, the color calibration device may perform the color calibration (e.g. primary color shift calibration) of the display panel.

In order to make the aforementioned features and advantages of the disclosure comprehensible, embodiments accompanied with drawings are described in detail below.

DESCRIPTION OF THE EMBODIMENTS

Figure 1:
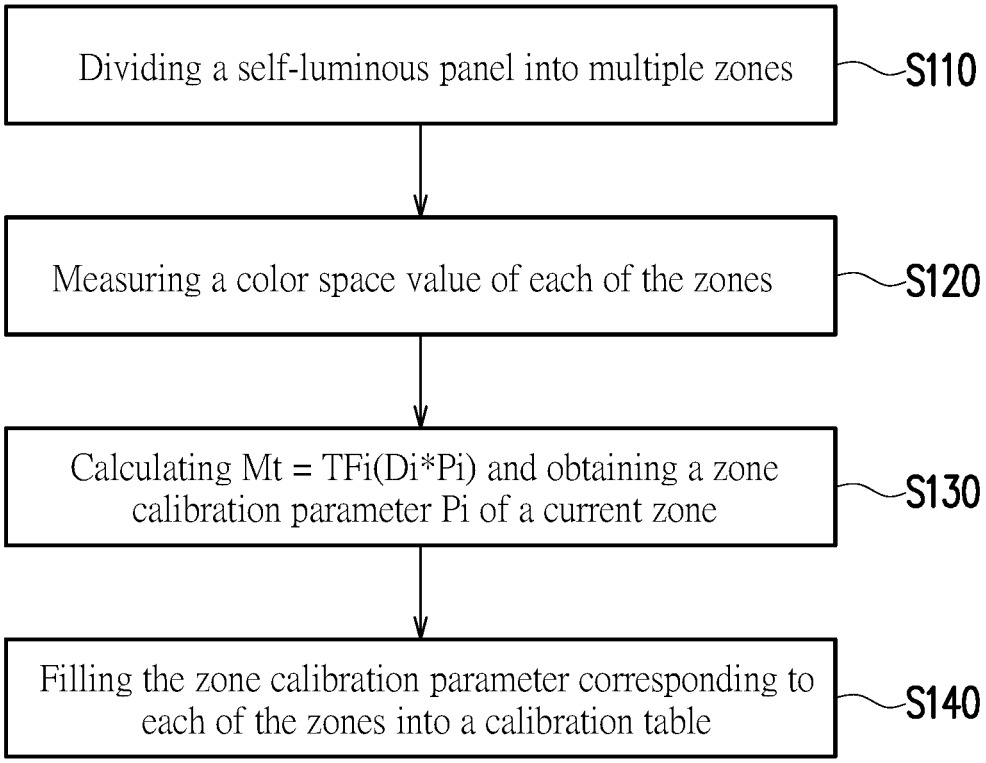
FIG. 1 is a flowchart of a calibration table generation method according to an embodiment of the disclosure.

The term "coupling/coupled (or connecting/connected)" used in the full text of this specification (including claims) may refer to any direct or indirect connection means. For example, if it is described that in the text "a first device is coupled (or connected) to a second device", it should be interpreted as "the first device is directly connected to the second device" or "the first device is indirectly connected to the second device through other devices or connection means." In addition, the terms such as "first" and "second" mentioned in the full text of the specification (including claims) are only used to name discrete elements or to distinguish different embodiments or scopes and are not intended to limit the upper or lower limit of the number of the elements, nor are they intended to limit the order of the elements. In addition, wherever possible, the elements/components/steps with the same reference numerals in the drawings and embodiments represent the same or similar parts. The elements/components/steps that use the same reference numerals or use the same terms in different embodiments may be cross-referenced for relevant descriptions.

FIG. 1 is a flowchart of a calibration table generation method according to an embodiment of the disclosure. According to actual application, the calibration table generation method shown in FIG. 1 may be implemented in a manufacturing process of a display device. A generated calibration table may be stored in the display device. For example, in the manufacturing process, the display device may be operated in one or multiple operation condition to prepare one or multiple calibration table corresponding to the one or multiple operation condition. In a normal display period, the color calibration device may select at least one calibration table among multiple candidate calibration tables according to the operation condition and calibrate original subpixel data of a current subpixel according a selected calibration table.

In step S110 as shown in FIG. 1, a display panel may be divided into multiple zones. According to an actual design, the display panel may be an organic light-emitting diode (OLED) display panel, a micro light emitting diode (Micro LED) display panel, or other self-luminous panels. In other embodiments, the display panel may be a non-self-luminous panel. A number of divided zones of the display panel is determined according to the actual design.

In step S120, a testing machine (not shown) may measure a color space value of each of the zones of the display panel. For example, the testing machine may measure a color space value Mi of an $i^{th}$ zone of the display panel. A certain zone of the zones of the display panel may be designated as a target zone (a reference zone). For example, in some embodiments, a central zone (or other zones) of the display panel may be designated as the target zone.

Each of the zones of the display panel has a dedicated transformation function. The transformation function may convert original pixel data into the color space value. With respect to the $i^{th}$ zone of the display panel, a relationship of the color space value Mi, a transformation function TFi( ), and original pixel data Di may be Mi=TFi(Di). For example, in some embodiments, the color space value Mi may be a coordinate $[X_{Wi}, Y_{Wi}, Z_{Wi}]$ of an XYZ color space. However, the applied color space is not limited to the XYZ color space. In other embodiments, the color space value Mi may be a coordinate of xyY color space, Lab color space, YUV color space, HSV color space or other color spaces. The original pixel data Di may include different color grayscale values (e.g. a red value R, a green value G, and a blue value B), and the transformation function TFi( ) may include a transformation matrix. With respect to the $i^{th}$ zone of the display panel, Equation 1 below may be referred to for the relationship of the color space value Mi, the transformation function TFi( ), and the original pixel data Di.

$$\begin{bmatrix} X_{Wi} \\ Y_{Wi} \\ Z_{Wi} \end{bmatrix} = \begin{bmatrix} X_{Ri} & X_{Gi} & X_{Bi} \\ Y_{Ri} & Y_{Gi} & Y_{Bi} \\ Z_{Ri} & Z_{Gi} & Z_{Bi} \end{bmatrix} \begin{bmatrix} R \\ G \\ B \end{bmatrix} \quad \text{Equation 1}$$

White chromaticity $[X_{Wi}, Y_{Wi}, Z_{Wi}]$ shown in Equation 1 may be the color space value Mi of the $i^{th}$ zone measured in step S120. The white chromaticity $[X_{Wi}, Y_{Wi}, Z_{Wi}]$ may be obtained through measuring equipment (the testing machine, not shown). The measuring equipment may measure white chromaticity of each of the zones of the display panel as the color space value measured in step S120. Taking the $i^{th}$ zone of the display panel as an example, when the display panel displays a white image, the measuring equipment may measure an XYZ color space coordinate (the white chromaticity $[X_{Wi}, Y_{Wi}, Z_{Wi}]$) of the $i^{th}$ zone of the white image as the color space value Mi of the $i^{th}$ zone.

Chromaticity $(X_R,Y_R,Z_R)$, $(X_G,Y_G,Z_G)$, and $(X_B,Y_B,Z_B)$ of three primary colors in a 3*3 transformation matrix shown in Equation 1 may be obtained through the measuring equipment (the testing machine, not shown). The measuring equipment may measure chromaticity of different colors of each of the zones of the display panel as different element columns in the transformation matrix. Taking the $i^{th}$ zone of the display panel as an example, when the display panel displays a red image, the measuring equipment may measure an XYZ color space coordinate (the red chromaticity $(X_{Ri}, Y_{Ri}, Z_{Ri})$) of the $i^{th}$ zone of the red image as a first element column in the transformation matrix shown in Equation 1. When the display panel displays a green image, the measuring equipment may measure an XYZ color space coordinate (the green chromaticity $(X_{Gi}, Y_{Gi}, Z_{Gi})$) of the $i^{th}$ zone of the green image as a second element column in the transformation matrix shown in Equation 1. When the display panel displays a blue image, the measuring equipment may measure an XYZ color space coordinate (the blue chromaticity $(X_{Bi}, Y_{Bi}, Z_B)$) of the $i^{th}$ zone of the blue image as a third element column in the transformation matrix shown in Equation 1. Therefore, each of the zones of the display panel has a dedicated transformation matrix (the transformation function).

Similarly, with respect to the target zone (the reference zone) of the display panel, a relationship Mt=TFt(Dt) of a color space value Mt, a transformation function TFt( ), and original pixel data Dt may be presented as Equation 2 below. That is, the color space value Mt may include a coordinate $[X_{Wt}, Y_{Wt}, Z_{Wt}]$ of the XYZ color space shown in Equation 2. The original pixel data Dt may include the red value R, the green value G, and the blue value B shown in Equation 2, and the transformation function TFt( ) may include a 3*3 transformation matrix shown in Equation 2.

$$\begin{bmatrix} X_{Wt} \\ Y_{Wt} \\ Z_{Wt} \end{bmatrix} = \begin{bmatrix} X_{Rt} & X_{Gt} & X_{Bt} \\ Y_{Rt} & Y_{Gt} & Y_{Bt} \\ Z_{Rt} & Z_{Gt} & Z_{Bt} \end{bmatrix} \begin{bmatrix} R \\ G \\ B \end{bmatrix} \quad \text{Equation 2}$$

In step S130, the testing machine (not shown) may calculate Mt=TFi(Di*Pi) to obtain a zone calibration parameter Pi of a current zone (e.g. the $i^{th}$ zone of the display panel) among the multiple zones of the display panel. Mt is the color space value of the target zone (the reference zone) among the multiple zones of the display panel, TFi( ) is the transformation function corresponding to the current zone, and Di is the original pixel data of the current zone. In some embodiments, Mt=TFi(Di*Pi) may be presented as Equation 3 below. Based on Equation 3, the testing machine may calculate the zone calibration parameter Pi of the $i^{th}$ zone, which are a red calibration parameter $Ratio_{Ri}$, a green calibration parameter $Ratio_{Gi}$, and a blue calibration parameter $Ratio_{Bi}$. However, the implementation example of the zone calibration parameter Pi is not limited to RatioRi, RatioGi and RatioBi. In other embodiments, the zone calibration parameter Pi may be a one-dimensional parameter (vector), a two-dimensional parameter (matrix), a multi-dimensional parameter (tensor) or other parameter forms.

$$\begin{bmatrix} X_{Wt} \\ Y_{Wt} \\ Z_{Wt} \end{bmatrix} = \begin{bmatrix} X_{Ri} & X_{Gi} & X_{Bi} \\ Y_{Ri} & Y_{Gi} & Y_{Bi} \\ Z_{Ri} & Z_{Gi} & Z_{Bi} \end{bmatrix} \begin{bmatrix} R \times \text{Ratio}_{Ri} \\ G \times \text{Ratio}_{Gi} \\ B \times \text{Ratio}_{Bi} \end{bmatrix} \quad \text{Equation 3}$$

In step S140, the testing machine (not shown) may fill the zone calibration parameter corresponding to each of the zones of the display panel into the calibration table. Based on the actual design, the display panel may be operated in multiple operation conditions, and the testing machine prepares multiple calibration tables corresponding to the different operation conditions. According to the actual design, the operation conditions may include a current subpixel grayscale, temperature, humidity, environmental color temperature, environmental brightness, and (or) other operation conditions. In the normal display period, the display device with the display panel may select the at least one calibration table among the multiple candidate calibration tables prepared in advance according to a current operation condition and calibrate the original subpixel data of the current subpixel according the selected calibration table.

Figure 2:
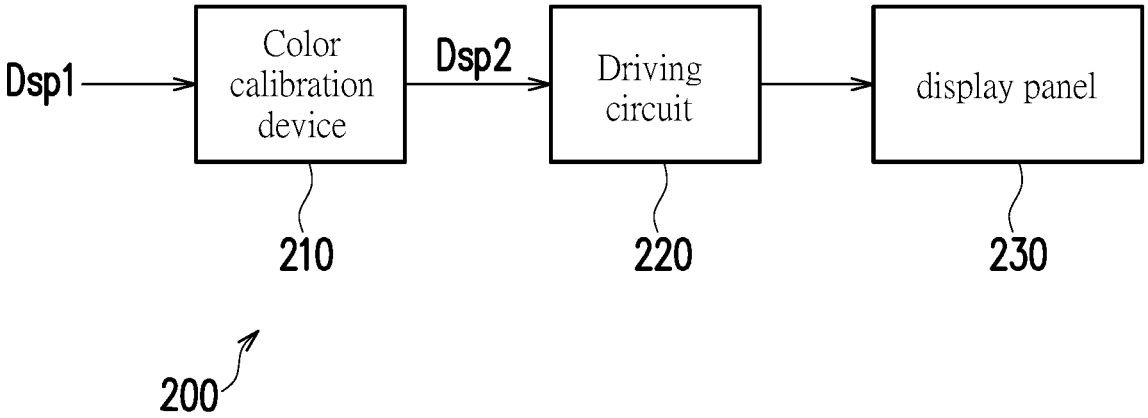
FIG. 2 is a circuit block diagram of a display device according to an embodiment of the disclosure.

FIG. 2 is a circuit block diagram of a display device 200 according to an embodiment of the disclosure. The display device 200 shown in FIG. 2 includes a color calibration device 210, a driving circuit 220, and a display panel 230. According to the actual design, the display panel 230 may be an OLED display panel, a Micro LED display panel, or other display panels. A number of divided zones of the display panel 230 is determined according to the actual design. The color calibration device 210 may calibrate original subpixel data Dsp1 of a current subpixel to generate calibrated subpixel data Dsp2 of the current subpixel for the driving circuit 220. Based on the calibrated subpixel data Dsp2, the driving circuit 220 may drive a corresponding subpixel (not shown) in the display panel 230. Hence, the display panel 230 may display an image based on a driving operation of the driving circuit 220. The embodiment is not intended to limit implementation details of the driving circuit 220. For example, in some embodiments, the driving circuit 220 may be a conventional display panel driving circuit or other driving circuits.

Figure 3:
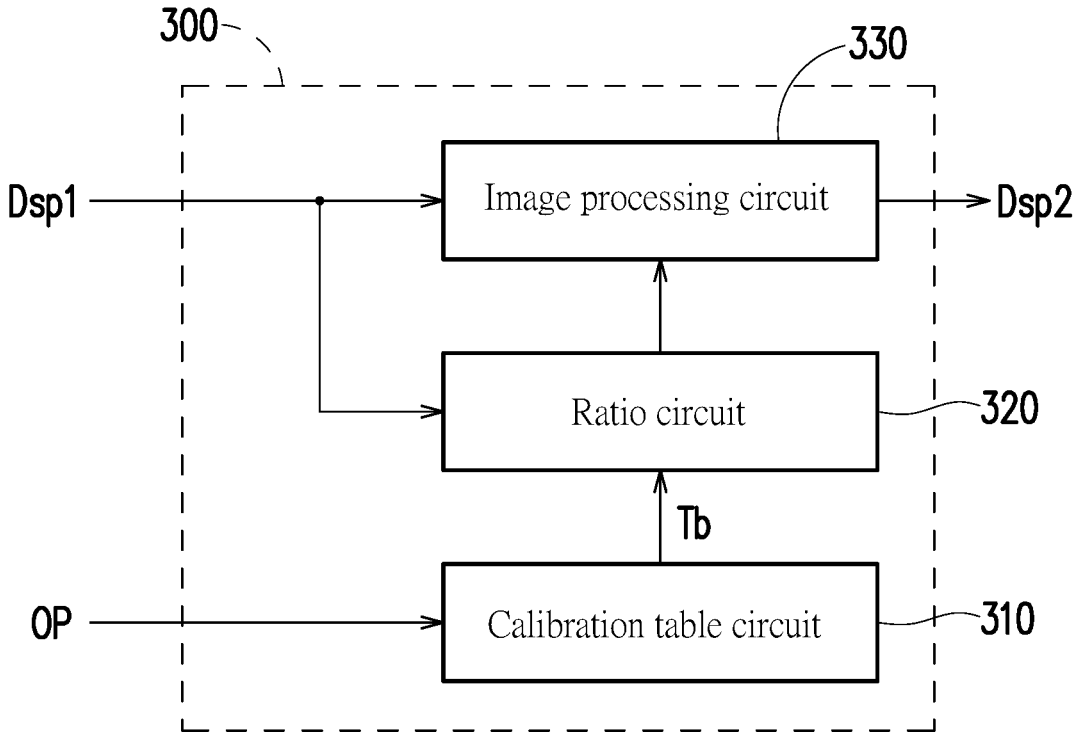
FIG. 3 is a circuit block diagram of a color calibration device according to an embodiment of the disclosure.

FIG. 3 is a circuit block diagram of a color calibration device 300 according to an embodiment of the disclosure. The color calibration device 300 shown in FIG. 3 may serve as one of multiple embodiments of the color calibration device 210 shown in FIG. 2. For relevant details of the color calibration device 300 shown in FIG. 3, relevant description of the color calibration device 210 shown in FIG. 2 may be referred to. The color calibration device 300 shown in FIG. 3 includes a calibration table circuit 310, a ratio circuit 320, and an image processing circuit 330. According to different design requirements, the calibration table circuit 310, the ratio circuit 320, and (or) the image processing circuit 330 may be implemented as hardware, firmware, or software (i.e. a program), or a combination of multiple ones among hardware, firmware, and software.

With respect to hardware implementation, the calibration table circuit 310, the ratio circuit 320, and (or) the image processing circuit 330 may be realized as a logic circuit on an integrated circuit. Relevant functions of the calibration table circuit 310, the ratio circuit 320, and (or) the image processing circuit 330 may be realized as the hardware by using hardware description languages (e.g. Verilog HDL or VHDL) or other suitable programming languages. For example, the relevant functions of the calibration table circuit 310, the ratio circuit 320, and (or) the image processing circuit 330 may be realized in one or more controller, microcontroller, microprocessor, application-specific integrated circuit (ASIC), digital signal processor (DSP), field Programmable Gate Array (FPGA), and/or various logic blocks, modules, and circuits in other processing units.

With respect to software and/or firmware implementation, the relevant functions of the calibration table circuit 310, the ratio circuit 320, and (or) the image processing circuit 330 may be realized as programming codes. For example, the calibration table circuit 310, the ratio circuit 320, and (or) the image processing circuit 330 may be realized by using general programming languages (e.g. C, C++, or a combination of languages) or other suitable programming languages. The programming codes may be recorded/stored in a "non-transitory computer readable medium". In some embodiments, the non-transitory computer readable medium includes, for example, a read only memory (ROM), a semiconductor memory, a programmable logic circuit, and (or) a storage device. A central processing unit (CPU), a controller, a microcontroller, or a microprocessor may read and execute the programming codes from the non-transitory computer readable medium to realize the relevant functions of the calibration table circuit 310, the ratio circuit 320, and (or) the image processing circuit 330.

Figure 4:
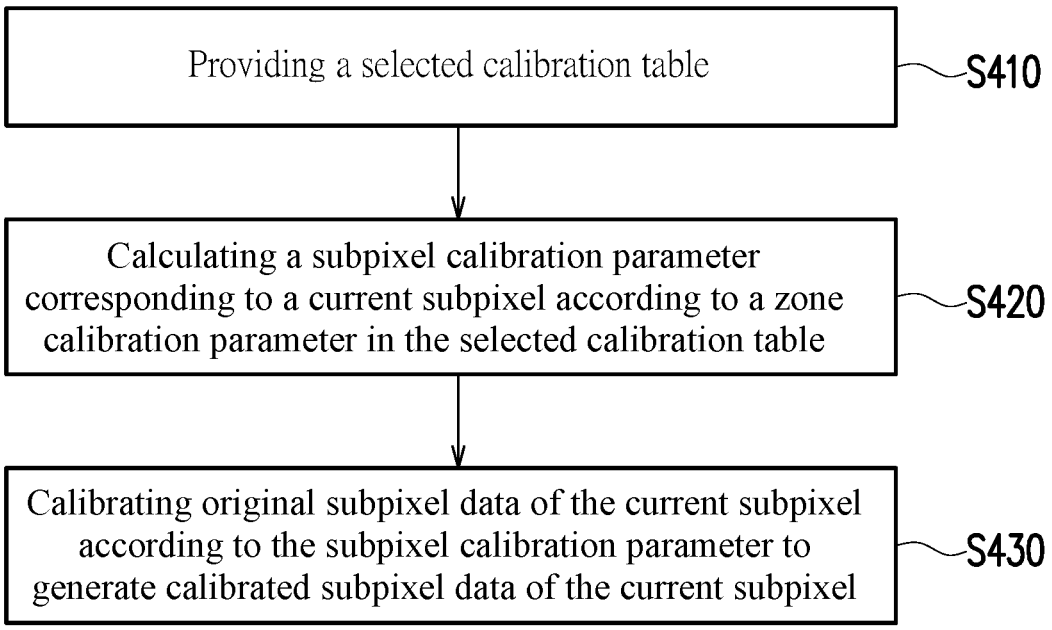
FIG. 4 is a flowchart of a color calibration method according to an embodiment of the disclosure.

FIG. 4 is a flowchart of a color calibration method according to an embodiment of the disclosure. Referring to FIG. 3 and FIG. 4, in step S410, the calibration table circuit 310 may provide a selected calibration table Tb for the ratio circuit 320. The selected calibration table Tb includes multiple zone calibration parameters, and each of the zone calibration parameters corresponds to a corresponding zone among the multiple zones of the display panel 230. For example, in some embodiments, the calibration table circuit 310 may select one of the multiple candidate calibration tables as the selected calibration table Tb according to at least one operation condition OP. According to the actual design, the at least one operation condition OP includes a current subpixel grayscale, temperature, humidity, environmental color temperature, environmental brightness, and (or) other operation conditions. Relevant description of FIG. 1 may be referred to for preparation details of the candidate calibration tables of the calibration table circuit 310. In other embodiments, the calibration table circuit 310 may select multiple tables among the multiple candidate calibration tables according to the at least one operation condition OP and perform interpolation by using the multiple tables to generate the selected calibration table Tb.

The ratio circuit 320 is coupled to the calibration table circuit 310 to receive the selected calibration table Tb. In step S420, the ratio circuit 320 may calculate a subpixel calibration parameter Rt corresponding to a current subpixel according to at least one of the zone calibration parameters in the selected calibration table Tb. For example, the ratio circuit 320 may perform interpolation by using the at least one of the zone calibration parameters in the selected calibration table Tb to generate the subpixel calibration parameter Rt corresponding to the current subpixel.

It is assumed that the current subpixel is located at the $i^{th}$ zone of the display panel 230, and an adjacent zone of the $i^{th}$ zone is an $i+1^{th}$ zone of the display panel 230. The ratio circuit 320 may access the zone calibration parameter Pi of the $i^{th}$ zone and a zone calibration parameter Pi+1 of the $i+1^{th}$ zone. Taking Equation 3 as an example, the zone calibration parameter Pi may include the red calibration parameter $Ratio_{Ri}$, the green calibration parameter $Ratio_{Gi}$, and the blue calibration parameter $Ratio_{Bi}$, and the zone calibration parameter Pi+1 may be obtained accordingly by referring to relevant description of the zone calibration parameter Pi. The ratio circuit 320 may perform interpolation by using the zone calibration parameters Pi and Pi+1 to generate the subpixel calibration parameter Rt corresponding to the current subpixel.

The image processing circuit 330 is coupled to the ratio circuit 320 to receive the subpixel calibration parameter Rt. In step S430, the image processing circuit 330 may calibrate the original subpixel data Dsp1 of the current subpixel according to the subpixel calibration parameter Rt to generate the calibrated subpixel data Dsp2 of the current subpixel. For example (but not limited thereto), the image processing circuit 330 may multiply the original subpixel data Dsp1 by the subpixel calibration parameter Rt to generate the calibrated subpixel data Dsp2. It is assumed that the original subpixel data Dsp1 includes a red value R1, a green value G1, and a blue value B1, and the subpixel calibration parameter Rt includes a red calibration parameter $Ratio_R$, a green calibration parameter $Ratio_G$, and a blue calibration parameter $Ratio_B$. The image processing circuit 330 may calculate "R2=R1*$Ratio_R$", "G2=G1*$Ratio_G$", and "B2=B1*$Ratio_B$" to generate a red value R2, a green value G2, and a blue value B2 of the calibrated subpixel data Dsp2.

In summary of the above, the calibration table generation method described in FIG. 1 may measure the color space value of each of the multiple zones of the display panel 230, and the zone calibration parameters of the zones are obtained according to the color space values of the zones. The zone calibration parameters of the zones may be filled in the candidate calibration table. The multiple candidate calibration tables may be prepared in advance for the different operation condition OP (e.g. a current subpixel grayscale, temperature, humidity, environmental color temperature, environmental brightness, and/or other operation conditions), and the candidate calibration tables are recorded in the calibration table circuit 310. In the normal display period, the calibration table circuit 310 selects one of the multiple candidate calibration tables as the selected calibration table Tb according to the at least one operation condition OP or selects the multiple tables among the multiple candidate calibration tables according to the at least one operation condition OP to generate the selected calibration table Tb. The ratio circuit 320 may calculate the subpixel calibration parameter Rt corresponding to the current subpixel according to the at least one of the zone calibration parameters in the selected calibration table Tb. The image processing circuit 330 may calibrate the original subpixel data Dsp1 of the current subpixel according to the subpixel calibration parameter Rt to generate the calibrated subpixel data Dsp2 of the current subpixel. Therefore, the color calibration device 210 (or 300) may calculate the subpixel calibration parameter Rt corresponding to the current subpixel and calibrate the original subpixel data Dsp1 of the current subpixel according to the subpixel calibration parameter Rt. Therefore, the color calibration device 210 (or 300) may perform the color calibration (e.g. the primary color shift calibration) of the display panel 230.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. A color calibration device, comprising:

a calibration table circuit configured to provide a selected calibration table, wherein the selected calibration table comprises a plurality of zone calibration parameters, and each of the zone calibration parameters corresponds to a corresponding zone among a plurality of zones of a display panel;

a ratio circuit coupled to the calibration table circuit to receive the selected calibration table and configured to calculate a subpixel calibration parameter corresponding to a current subpixel according to at least one of the zone calibration parameters in the selected calibration table; and an image processing circuit, coupled to the ratio circuit to receive the subpixel calibration parameter, and configured to calibrate original subpixel data of the current subpixel according to the subpixel calibration parameter to generate calibrated subpixel data of the current subpixel, wherein the calibration table is generated by measuring a color space value of each of the zones, wherein each of the zones has a transformation function to convert original pixel data into the color space value; calculating Mt=TFi(Di*Pi) to obtain a zone calibration parameter Pi of a current zone, wherein Mt is a known color space value of a target zone among the zones, TFi( ) is the transformation function corresponding to the current zone among the zones, and Di is the original pixel data of the current zone; and filling the zone calibration parameter corresponding to each of the zones in the calibration table.

2. The color calibration device according to claim 1, wherein the image processing circuit multiplies the original subpixel data by the subpixel calibration parameter to generate the calibrated subpixel data.

3. The color calibration device according to claim 1, wherein the ratio circuit performs interpolation by using the at least one of the zone calibration parameters to generate the subpixel calibration parameter corresponding to the current subpixel.

4. The color calibration device according to claim 1, wherein the calibration table circuit selects one of a plurality of candidate calibration tables as the selected calibration table according to at least one operation condition.

5. The color calibration device according to claim 4, wherein the at least one operation condition comprises a current subpixel grayscale, temperature, humidity, environmental color temperature or environmental brightness.

6. The color calibration device according to claim 1, wherein the calibration table circuit selects a plurality of tables among a plurality of candidate calibration tables according to at least one operation condition and performs interpolation by using the plurality of tables to generate the selected calibration table.

7. A color calibration method, comprising:

providing a selected calibration table by a calibration table circuit, wherein the selected calibration table comprises a plurality of zone calibration parameters, and each of the zone calibration parameters corresponds to a corresponding zone among a plurality of zones of a display panel;

calculating, by a ratio circuit, a subpixel calibration parameter corresponding to a current subpixel according to at least one of the zone calibration parameters in the selected calibration table; and calibrating, by an image processing circuit, original subpixel data of the current subpixel according to the subpixel calibration parameter to generate calibrated subpixel data of the current subpixel, wherein the calibration table is generated by measuring a color space value of each of the zones, wherein each of the zones has a transformation function to convert original pixel data into the color space value; calculating Mt=TFi(Di*Pi) to obtain a zone calibration parameter Pi of a current zone, wherein Mt is a known color space value of a target zone among the zones, TFi( ) is the transformation function corresponding to the current zone among the zones, and Di is the original pixel data of the current zone; and filling the zone calibration parameter corresponding to each of the zones in the calibration table.

8. The color calibration method according to claim 7, wherein generating the calibrated subpixel data of the current subpixel comprises:

multiplying the original subpixel data by the subpixel calibration parameter to generate the calibrated subpixel data.

9. The color calibration method according to claim 7, wherein calculating the subpixel calibration parameter corresponding to the current subpixel comprises:

performing interpolation by using the at least one of the zone calibration parameters to generate the subpixel calibration parameter corresponding to the current subpixel.

10. The color calibration method according to claim 7, further comprising:

selecting one of a plurality of candidate calibration tables as the selected calibration table according to at least one operation condition.

11. The color calibration method according to claim 10, wherein the at least one operation condition comprises a current subpixel grayscale, temperature, humidity, environmental color temperature or environmental brightness.

12. The color calibration method according to claim 7, further comprising:

selecting a plurality of tables among a plurality of candidate calibration tables according to at least one operation condition; and performing interpolation by using the plurality of tables to generate the selected calibration table.

13. A calibration table generation method, comprising:

dividing a display panel into a plurality of zones;

measuring a color space value of each of the zones, wherein each of the zones has a transformation function to convert original pixel data into the color space value;

calculating Mt=TFi(Di*Pi) to obtain a zone calibration parameter Pi of a current zone, wherein Mt is a known color space value of a target zone among the zones, TFi( ) is the transformation function corresponding to the current zone among the zones, and Di is the original pixel data of the current zone; and filling the zone calibration parameter corresponding to each of the zones in a calibration table.

14. The calibration table generation method according to claim 13, wherein the color space value is a coordinate of an XYZ color space, the original pixel data comprises a red value, a green value, and a blue value, and the transformation function comprises a transformation matrix.

15. The calibration table generation method according to claim 14, wherein measuring the color space value of each of the zones comprises:

displaying a white image from the display panel; and measuring an XYZ color space coordinate of each of the zones of the white image as the color space value.

16. The calibration table generation method according to claim 14, further comprising:

displaying a red image from the display panel;

measuring an XYZ color space coordinate of each of the zones of the red image as a first element column of the transformation matrix;

displaying a green image from the display panel;

measuring an XYZ color space coordinate of each of the zones of the green image as a second element column of the transformation matrix;

displaying a blue image from the display panel; and measuring an XYZ color space coordinate of each of the zones of the blue image as a third element column of the transformation matrix.

* * * * *